US011433287B2

(12) United States Patent
Griffin

(10) Patent No.: US 11,433,287 B2
(45) Date of Patent: Sep. 6, 2022

(54) PUTTING ALIGNMENT TRAINING DEVICE

(71) Applicant: James David Griffin, Maryville, TN (US)

(72) Inventor: James David Griffin, Maryville, TN (US)

(73) Assignee: SMOKYGOLF LLC, Alcoa, TN (US)

( * ) Notice: Subject to any disclaimer, the term of this patent is extended or adjusted under 35 U.S.C. 154(b) by 0 days.

(21) Appl. No.: 17/323,639

(22) Filed: May 18, 2021

(65) Prior Publication Data

US 2022/0105409 A1 Apr. 7, 2022

Related U.S. Application Data

(60) Provisional application No. 63/086,361, filed on Oct. 1, 2020.

(51) Int. Cl.
*A63B 69/36* (2006.01)

(52) U.S. Cl.
CPC ..... *A63B 69/3608* (2013.01)

(58) Field of Classification Search
CPC ..... A63B 69/3608; A63B 36/36
See application file for complete search history.

(56) References Cited

U.S. PATENT DOCUMENTS 5,538,250 A * 7/1996 Putz ..... A63B 69/3608 473/409
6,383,087 B1 5/2002 Moser
7,228,649 B2 6/2007 Elliott
7,713,061 B1 * 5/2010 Albertini ..... A63B 69/3667 473/409
9,555,303 B1 * 1/2017 Novosel, Sr. ..... A63B 15/00
2003/0109320 A1 * 6/2003 Perry ..... A63B 69/3608 473/215
2004/0106462 A1 6/2004 Ianazone
2004/0259656 A1 * 12/2004 Miracle ..... A63B 69/3608 473/268
2008/0153615 A1 * 6/2008 Baird ..... A63B 69/3608 473/207
2009/0181787 A1 * 7/2009 Lane ..... A63B 69/3673 473/212
2011/0111876 A1 * 5/2011 Hart ..... A63B 69/0059 473/257
2011/0300962 A1 * 12/2011 Wright ..... A63B 69/3621 473/409
2013/0267334 A1 * 10/2013 Valle ..... A63B 69/0059 473/215
2015/0151181 A1 * 6/2015 Jones ..... A63B 69/3608 473/210
2018/0126243 A1 * 5/2018 Vilhelmsen ..... A63B 69/0059

* cited by examiner

*Primary Examiner* — Raleigh W Chiu
(74) *Attorney, Agent, or Firm* — Nelson Mullins Riley & Scarborough LLP

(57) ABSTRACT

A putting alignment training device that is securable to an upper torso of a user, having an elongated shoulder board, an adjustable harness that is secured to the shoulder board and configured to secure the training device to a front side of the upper torso, a frontal board, an adjustable connector that secures the frontal board to the shoulder board, a grid board including a grid formed by a plurality of horizontal lines and a plurality of vertical lines wherein one of the plurality of horizontal lines and the plurality of vertical lines are parallel to the shoulder board.

12 Claims, 20 Drawing Sheets

PUTTING ALIGNMENT TRAINING DEVICE

CLAIM OF PRIORITY

This application claims priority to U.S. provisional patent application No. 63/086,361 filed Oct. 1, 2020, the disclosure of which is incorporated by reference herein.

TECHNICAL FIELD

The presently disclosed invention relates generally to devices and methods of use thereof for assisting athletes in the game of golf and, more specifically, to devices and methods of use thereof for training athletes in the discipline of putting.

BACKGROUND

This invention involves a training device used in golf to improve a golfer's score. More specifically, it is a device used to train a golfer in properly aligning the body and the putter prior to making a putt so that accuracy of the putt is improved. The training device can be used by both right-handed and left-handed golfers.

The game of golf is played on a course set up with a round typically consisting of 9 to 18 holes, each having a tee, a fairway, a green, and a hole on the green. Golf involves the use of clubs to strike the ball in as few strokes as possible from tee, to fairway, to green, and into the hole. Strokes taken on the greens are called putts. Club used for this purpose is the putter.

A typical golfer in a typical round will take 30% to 50% of total strokes as putts on the greens. Therefore, it is very important that in order to become a better golfer, the art of putting should be improved. Putting involves a proper grip, proper stance, and proper alignment of the putter and body prior to making the putt and proper stroke, including proper speed, during the putt. Depending on length of putt, even a misalignment of a very few degrees can result in a missed putt. Many putts are missed due to improper alignment prior to attempting the putt, although speed of the putt or the putting stroke itself may cause many misses as well. Misalignment prior to the putt can occur because the putter face has not been positioned perpendicularly to the correct line from the ball to the hole prior to taking one's stance. As well, the putter may be properly positioned and the stance, that is the position of the feet, is not properly aligned, that is with a line from the tip of the toe of one shoe to the tip of the toe of the other shoe. Preferably this line should be parallel to the line from the ball to the hole. Finally, the putter can be aligned correctly and feet aligned correctly but the body, primarily the shoulders, are slightly out of line. That is, the shoulders not parallel to the line from the ball to the hole. Any of these misalignments can, and often do, cause missed putts. The present training device seeks to assist the user during practice and help to correct these misalignments during an actual round, when rules prevent the use of such devices.

Over time, golfers have used, and still do use, many putting techniques. However, in recent years it has become most common among professional and amateur golfers alike to use what is generally called the pendulum method, or pendulum stroke. This method involves keeping the lower part of the body still and moving the shoulders and arms and hands in a pendulum motion, similar to a pendulum of a grandfather clock, with little or no movement or rotation of the torso. To do this, a triangle is formed running from the hands to each shoulder, and from shoulder to shoulder. This triangle stays fixed during the putt and only rotates back and forth as described above. The wrists should not be allowed to break or rotate independently of the triangle during the putt, and body from waist down should not be allowed to move.

Because most golfers position their eyes directly, or nearly directly, over the golf ball when taking their stance, and have a forward lean from the waist with the putter head extended out rather than straight down from the shoulders, their shoulders are not typically positioned straight over the ball when taking their stance prior to attempting the putt. Rather, their shoulders are nearly directly over the tips of their toes, that is, inside the line from golf ball to hole. Because of this type stance, employed by many golfers, the pendulum stroke will actually have a very small arc just inside the target line on the backstroke, be square to the target line at impact and have a very small arc just inside the target line on the follow through after contact is made with the golf ball. The longer the putt, generally speaking, the longer the backswing and the follow through and, therefore, the greater the arc. As such, many golfers find that centering the face of the putter between their feet at address is best because the putter face is square to the target at impact and, therefore, perpendicular to the target line at impact rather than skewed from the line extending from the golf ball to the hole. Having weight equally distributed on the feet is important in achieving this centering process. In this method of address, the ball is slightly ahead of center because the ball is ahead of the putter face which is centered. Stated another way, an imaginary line starting from center of the putter face and running through the center of the golf ball to center of the hole will be tangent to the arc made by the putter at time of impact if the face of the putter head has been centered at midpoint between the feet and a proper normal putting stroke is made using the pendulum method.

Because most golfers now use this pendulum technique, and, due to the arc of the putting stroke, it is essential that the whole body, to include the feet, knees, hips, and shoulders, be properly aligned parallel to line from ball to hole prior to attempting the putt and that the putter face be centered between the feet with face perpendicular to line from the ball to the hole.

Typical known training devices have focused on aligning one part of the body, the putter, or articles of clothing, but overlooked the rest of the body. These have included attaching an alignment device to the golfer's shoes (U.S. Pat. No. 7,228,649 B2), a device attached to the hat or eyeglasses (U.S. Publication No. 2004/0106462 A1), and a device attached to the putter (U.S. Pat. No. 6,383,087 B1).

To assist a golfer in aligning an attempted putt, there are things which a golfer may legally employ which are not part of this invention itself, and not necessary for the effective use of the invention, but may or may not be used in conjunction with this invention as an added tool in the alignment process. For example, all putters are legally constructed so that the grip has a flat rather than rounded surface on the front of the putter, this flat surface being perpendicular to the putter face. Therefore, when the golfer takes his grip, typically with both thumbs on top and facing down the shaft toward the ball, the putter face will be perpendicular to this flat side.

Almost all golf balls are now constructed with an alignment line or arrow imprinted on the ball. To use this line, a golfer crouches behind the ball. After spotting the ball with a marker, the golfer may then sight the line from ball to hole and legally move the ball and rotate it in such a way that he can align the line on the ball with the sighted path from the ball to the hole. Having done so, he then removes the marker prior to attempting the putt. This method is only as good as the golfer's ability to properly line up the line on the ball with the proper line to the hole. Another legal embodiment which a golfer may use to improve alignment is a line drawn on the head of the putter pointing in the direction that the ball is to be hit, this direction being perpendicular to the face of the putter which strikes the ball. This method also is only as good as the golfer's ability to properly line up the line on the putter head to the proper line to the hole.

In putting training, but not in actual play, a golfer may use a putting mat with alignment lines that run parallel to the intended line that the putt is to travel. Such devices may also be equipped with lines that run perpendicular to the line that the putt is to travel so that the feet may be properly positioned. In other words, a set of grid lines, horizontal and vertical or horizontal only, may be imprinted on a mat that the golfer uses to practice putting. Such mats usually include a ramp at the end of the putt with a hole that shuttles the ball to a returning trough to return the ball to the golfer by gravity. Such putting mats may be helpful in the use of the training devices described herein and to facilitate practice, but are not essential to the functioning of the devices. Also, a line on the putter may be helpful, but not essential, in use of the described training devices as the line on the putter may be lined up with the laser lines or gridlines, as described in greater detail below. Finally, the technique of lining up the line or arrow on the ball to point to the hole may be used with this invention if this is the golfer's normal putting technique. However, if this line does not coincide with the grid lines or laser lines per the disclosed training devices which are more accurate, the line on the ball should be realigned or simply ignored in practice putting. To reiterate, the disclosed training devices can be used successfully without the aid of any other aligning devices such as, but not limited to, a line on the putter, a line on the ball, or grid lines on a mat.

During practice, the embodiments of training devices discussed below have features to assist with aligning the feet properly, which means parallel to a line from the ball to the hole, aligning the face of the putter properly, which means perpendicular to the line from the ball to the hole, and aligning the shoulders properly, which means parallel to the line from the ball to the hole, which in turn causes the hips and knees to be aligned in the same manner.

As such, there at least remains a need, therefore, for devices and methods for assisting athletes in the game of golf to practice putting.

SUMMARY OF INVENTION

One embodiment of the present invention provides a putting alignment training device that is securable to an upper torso of a user, the training device having an elongated shoulder board, an adjustable harness that is secured to the shoulder board and configured to secure the training device to a front side of the upper torso, a frontal board, an adjustable connector that secures the frontal board to the shoulder board, and a grid board including a grid formed by a plurality of horizontal lines and a plurality of vertical lines, wherein one of the plurality of horizontal lines and the plurality of vertical lines are parallel to the shoulder board.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

The invention now will be described more fully hereinafter with reference to the accompanying drawings, in which some, but not, all embodiments of the invention are shown. Indeed, this invention may be embodied in many different forms and should not be construed as limited to the embodiments set forth herein; rather, these embodiments are provided so that this disclosure will satisfy applicable legal requirements.

Figure 1:
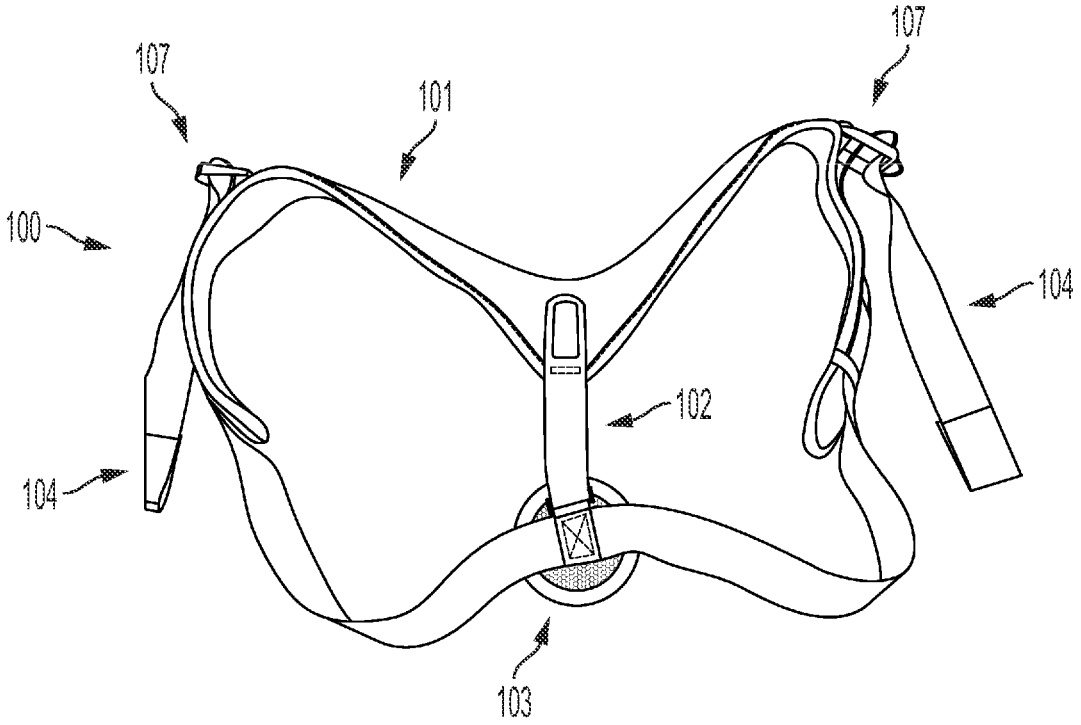
FIG. 1 is a perspective view of a shoulder harness in accordance with an embodiment of present invention.

Repeat use of reference characters in the present specification and drawings is intended to represent same or analogous features or elements of the invention according to the disclosure.

DESCRIPTION OF THE PREFERRED EMBODIMENTS

Reference will now be made to presently preferred embodiments of the invention, one or more examples of which are illustrated in the accompanying drawings. Each example is provided by way of explanation, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the golfer and training device, such as but not limited to "vertical," "horizontal," "upper," "lower," "above," or "below," refer to directions and relative positions with respect to the golfer's orientation in his normal intended position, as indicated in the Figures herein. Thus, for instance, the terms "vertical" and "upper" refer to the vertical direction and relative upper position in the perspectives of the Figures and should be understood in that context.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Reference will now be made to presently preferred embodiments of the invention, one or more examples of which are illustrated in the accompanying drawings. Each example is provided by way of explanation, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present disclosure is related to putting alignment used in golf training to improve putting skills by improving a golfer's ability to properly line up a putt prior to actually attempting the putt. For example, as discussed in greater detail below, embodiments include devices worn on the body that include a transparent grid, or lasers that cast laser lines or dots on the putting surface. By aligning these lines with a line from the golf ball to the hole, the golfer's body is simultaneously lined up correctly, that is with shoulders, hips, knees, and feet parallel to the line from the ball to the hole.

Embodiments of putting alignment training devices in accordance with the present disclosure fall into two broad categories, those involving a grid, of which there are four, and those involving lasers, of which there are three. One embodiment is described as an adjustable grid embodiment (FIG. 2), and three embodiments include fixed grids and are described as a fixed grid embodiment (FIG. 8), a fixed grid embodiment with continuous connectors (FIG. 16), and an assembly grid embodiment (FIG. 17). The laser embodiments are described as a line lasers embodiment (FIG. 9), a pointer laser embodiment (FIG. 11), and a dual line laser embodiment (FIG. 13), dual meaning emitting both a horizontal and vertical beam at the same time.

Referring now to the Figures, a first embodiment of a putting alignment training device, more specifically, the adjustable grid embodiment 106, is described. The adjustable grid embodiment 106 includes a harness 100, as best seen in FIG. 1, a shoulder board 105 as best seen in FIG. 2, with the attachment to the body of a user shown in FIGS. 5, 6, and 7.

The purpose of the harness 100 is to attach the shoulder board 105 to the front of the golfer's shoulders. The harness 100 preferably includes a strap 101 that encircles the shoulders of the golfer with a connector strap 102 and pad 103 at the back. Adjustable shoulder straps 104 and a plastic locking component 107 allow the golfer to tighten the straps as necessary to cause the shoulder board 105 to rest firmly against the front of his shoulders. Preferred material of the harness 100 is synthetic cloth, but other materials may be used. The shoulder board 105 is preferably constructed so that length is slightly wider than the golfer's shoulders. Therefore, the shoulder board 105 may be produced in varying sizes as needed, such as long, medium, and short. Preferred material of the shoulder board 105 is wood, but other materials such as plastics may be used. Construction of the harness 100 and shoulder board 105 is similar for all the embodiments discussed in greater detail below, with the exception of the assembly grid embodiment 143 (FIG. 17) so this construction will not be repeated where it would be repetitive. Also, where operation of one embodiment is the same as that of another embodiment it will not be repeated, but simply referred to as the same to avoid unnecessary repetition.

Figure 2:
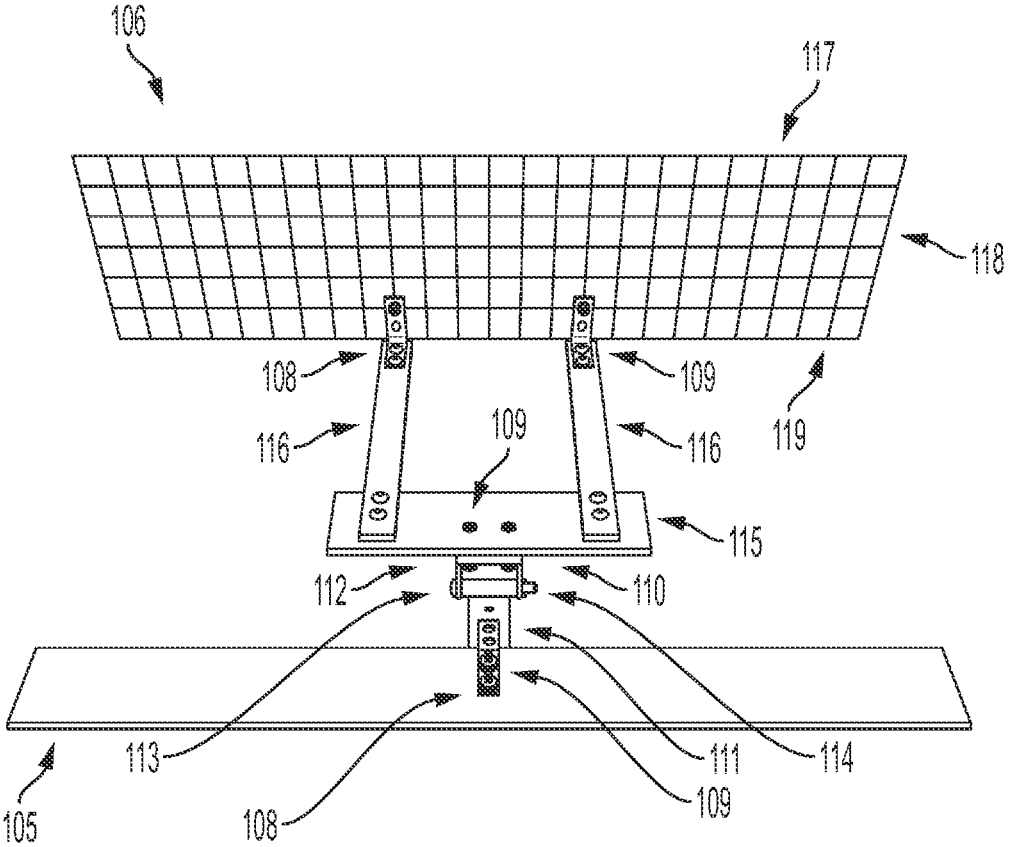
FIG. 2 is a perspective view of an adjustable grid embodiment of a putting alignment training device in accordance with an embodiment of the present invention.
Figure 3:
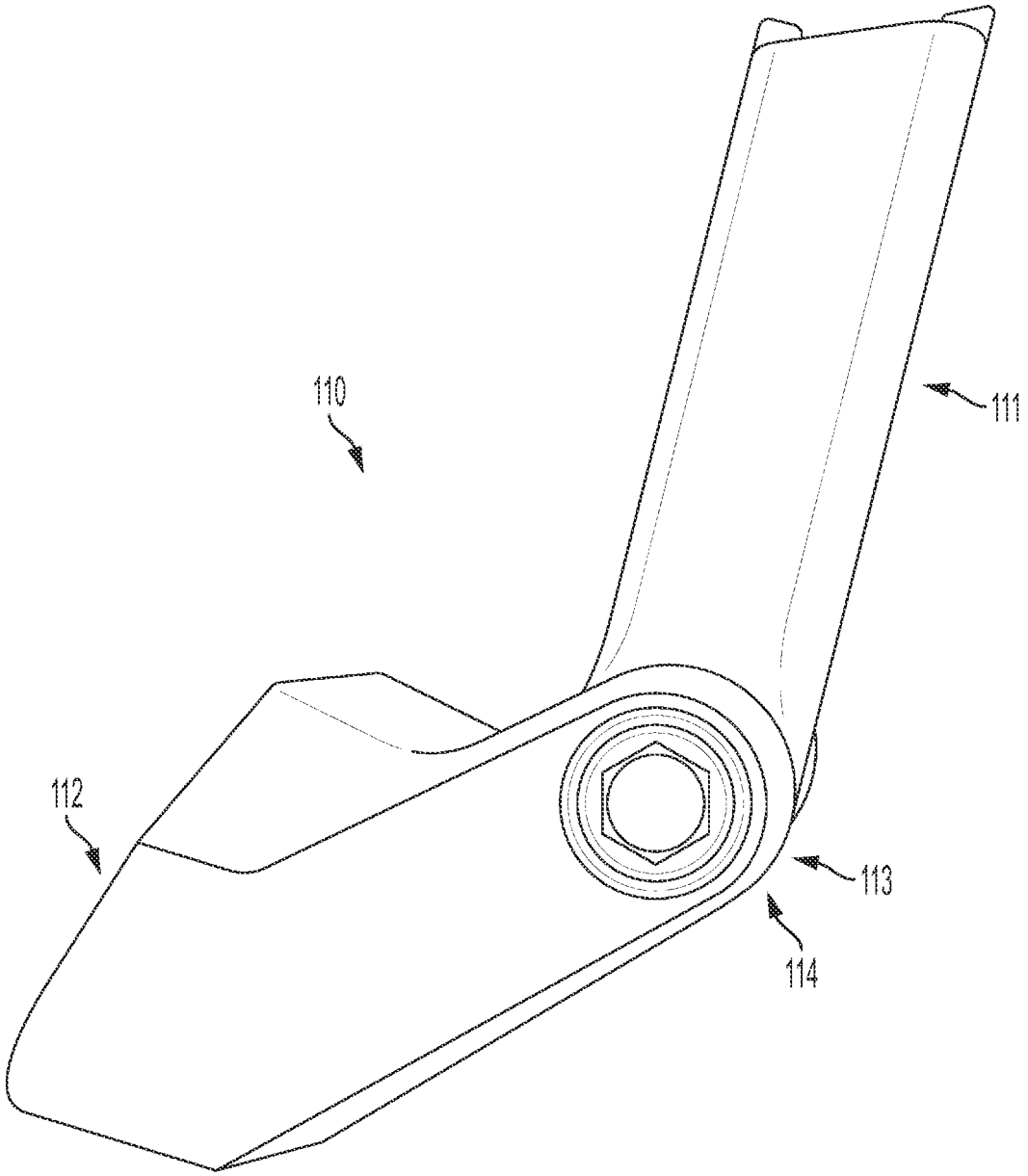
FIG. 3 is a side view of an adjustable connector in accordance with an embodiment of the present invention.
Figure 4:
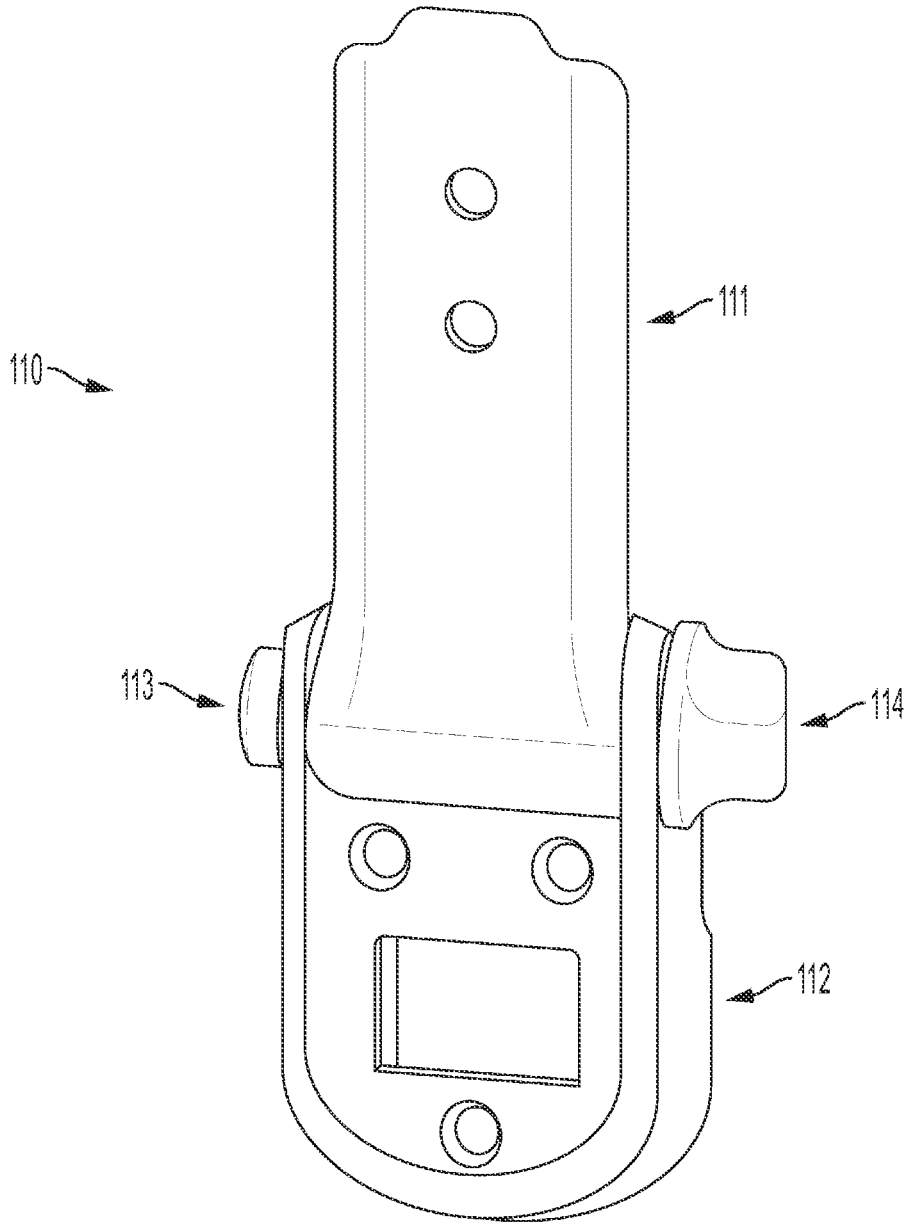
FIG. 4 is a front view of the adjustable connector shown in FIG. 3.

Referring specifically to FIG. 2, the adjustable grid embodiment 106 includes an adjustable connector 110, connected to a shoulder board 105 by an L bracket 108 and nuts and bolts 109. The connector 110 is further detailed in FIG. 3, a side view, and FIG. 4, a view facing the golfer. The connector 110 connects the shoulder board 100 to the frontal board 115. The connector 110 consists of a first part 111 attached to the shoulder board 105, a second part 112 attached to the frontal board 115, and a rotating component in the middle. The rotating component consists of a rotating cylindrical component 113 and a set screw 114. The rotation is around an axis that is parallel to the shoulder board 105 and frontal board 115 and runs through the center of the cylindrical component 113. Preferred material of the connector 110 is plastic, but other materials, such as metals, may be used. The preferred material of the L brackets 108 is metal, but other materials may be used, such as plastics. The purpose of the adjustable feature of the connector is to allow golfers with different heights, or body positions each takes when taking his normal stance prior to putting, to adjust the frontal board 115 so that the lines of the grid 117, or the laser lines 123 and 137 as will be explained later with regard to alternate embodiments, are in the golfer's sight without altering the golfer's normal stance.

Attached to the frontal board 115 by nuts and bolts 109 are two extender boards 116. Preferred material of the extender boards is wood, but other materials, such as plastics, may be used. The purpose of the extender boards 116 is to extend the rectangular transparent component, which is referred to as the grid 117, further away from the golfer's eyes so that lines on the grid 117 are distinct and not blurred. Preferred material of the frontal board 115 is wood, but other materials, such as plastics, may be used. The grid 117 is attached to the extender boards 116 by L brackets 108 and nuts and bolts 109. The grid 117 includes horizontal grid lines 118 and optional vertical grid lines 119 thereon. The horizontal lines 118 are parallel to the shoulder board 105 and since the grid 117 is connected to the shoulder board 105, any rotation of the shoulders will rotate the grid at the same time, meaning the shoulder board 105 and horizontal lines 118 of the grid 117 remain parallel. Horizontal lines 118 on the grid 117 may be many, few, or only one. As noted above, vertical lines 119 are optional and may be many, few or none. The grid 117 can be produced with varying lengths and widths. The greater the length of the grid 117, the longer the line of sight from the golfer's eyes to the hole 129 (FIG. 5), and hence the longer the putt that may be practiced. Additional holes may be placed in the grid 117 to allow for lateral movement by removing the nuts and bolts 109, which may be optional wing nuts 109, and then reattaching the grid 117, thus allowing for longer putts to be practiced. Preferred material of the grid 117 is polycarbonate, but other transparent materials may be used.

Figure 5:
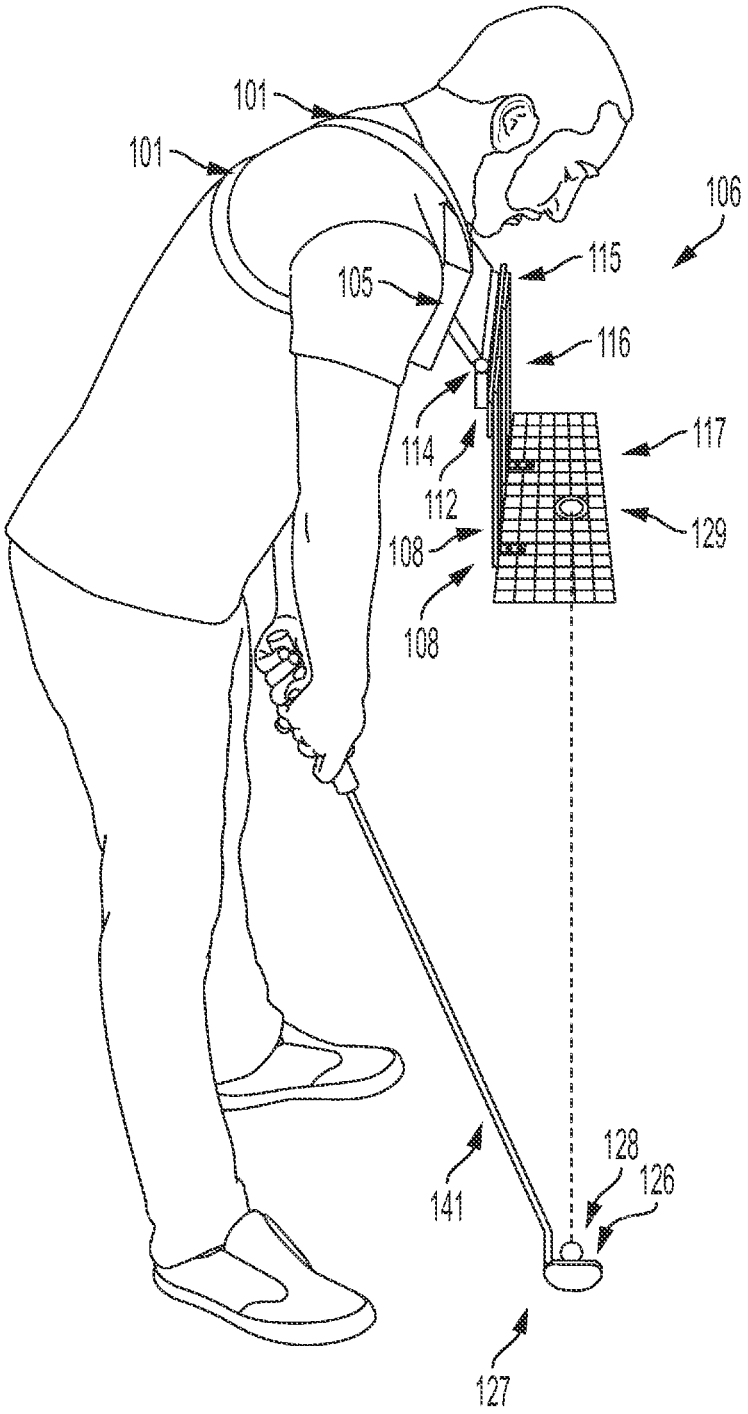
FIG. 5 is a side view of the putting alignment training device shown in FIG. 2, positioned on a golfer.
Figure 6:
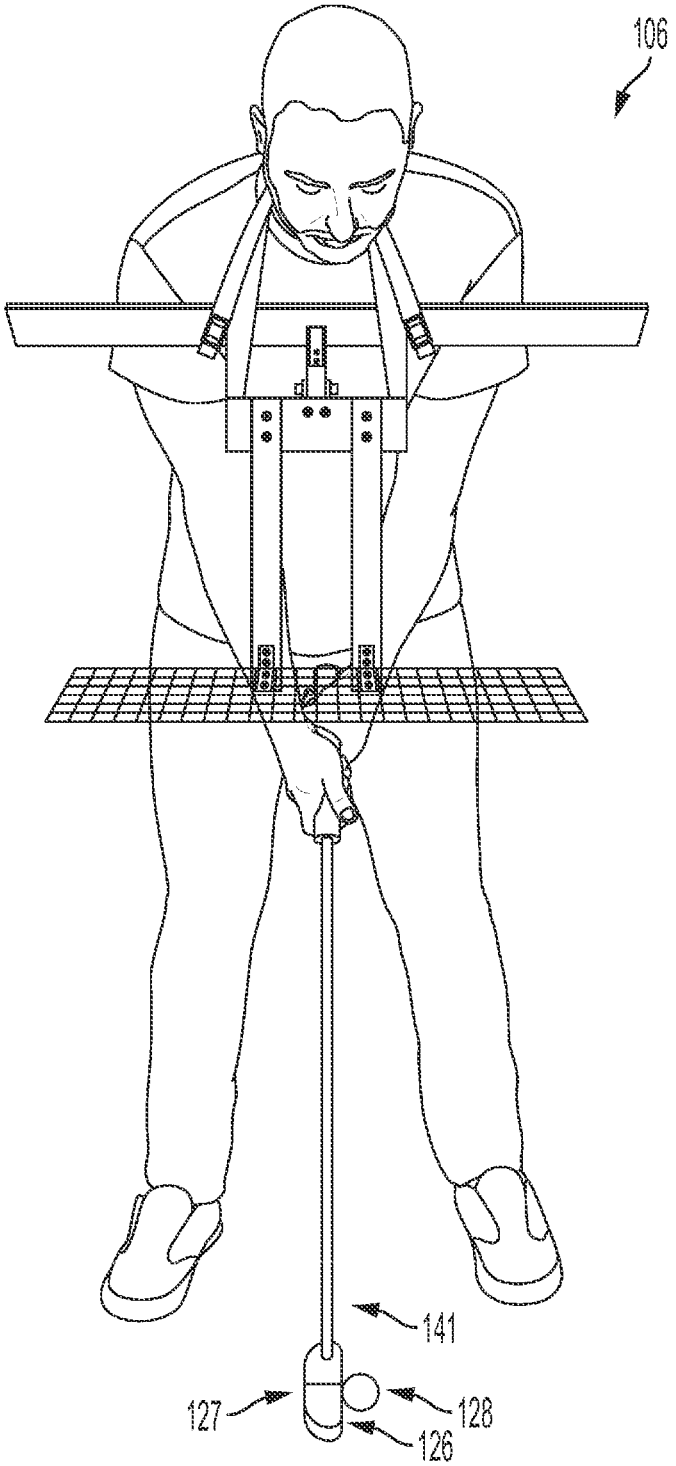
FIG. 6 is a front view of the golfer and the putting alignment training device shown in FIG. 5.
Figure 7:
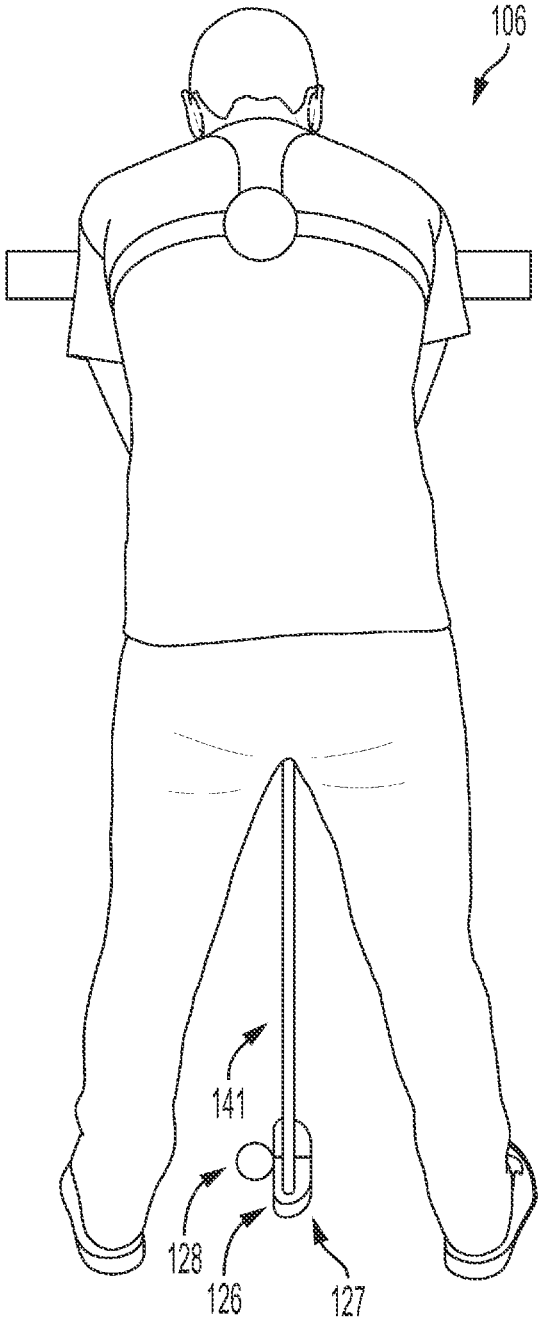
FIG. 7 is a back view of the golfer and the putting alignment training device shown in FIG. 5.

Referring now to FIGS. 5 through 7, the use of the adjustable grid embodiment 106 is described. First, the golfer dons the shoulder harness 100. Next, the golfer inserts both ends of the shoulder board inside the harness 100 at the front of his body, centers the embodiment 106 between the shoulders, and tightens the straps 104. It should be noted that centering the embodiment 106 on the body is preferable because it is balanced, but the embodiment can be off-centered to the left for a right-handed golfer or to the right for a left-handed golfer, so as to extend the ability of the golfer to see further down the line to the target hole 129. Next, the golfer takes his normal stance and normal grip on the putter 141 and centers the putter face 126 midway between his feet, with weight evenly distributed on both feet. The golfer then adjusts the frontal board 115 using the adjustable connector 110 so that one horizontal line 118 of the grid 117 will line up on the line from ball to the hole 129, and he then tightens the set screw 114. Grips and stances of golfers vary widely, so no attempt will be made to discuss any one in particular. However, regardless of the golfer's grip or stance, the principles outlined in this invention apply. For example, by using the invention to line up the entire body parallel to the line from the ball to the hole and set the putter face perpendicular to this line, proper alignment is achieved. After adjusting the connector 110 and setting the set screw 114, the golfer lines up one parallel line from the middle of the ball 128 to middle of hole 129 by rotating the shoulders and, using different parallel lines of the grid 117, lines up the tips of his toes parallel to this line.

It should be noted that during the alignment process the whole body is involved, that is, the rotation of the shoulders around an axis running through the middle of the torso from shoulders to waist, causes the torso, hips, and knees to also rotate so that the whole body is aligned. However, preferably, during the stroke there is no movement of the body from the waist down, and the shoulders rotate the arms, wrists, and hands, which stay fixed during the stroke. As well, the head preferably stays down and does not move from side to side or up and down. As well, the rotation of the shoulders should be accomplished with slight rotation of the torso, also around the axis referred to above. These stroke issues are provided here for information only, but this invention does not make claims as to stroke methods. FIGS. 5, 6, and 7 show different views of the adjustable grid embodiment 106 on the golfer at address, when the alignment process takes place. As explained previously, the shoulder board 105 and harness 100 are common to all the disclosed embodiments. The attachment to the body as shown in FIGS. 5, 6, and 7 is the same for all the disclosed embodiments. Therefore, to avoid repetition, these aspects of the drawings are not described repeatedly when not necessary, and the drawings which ensue reflect only those aspects unique to each embodiment. After aligning the entire body as described above, and as will be described in other embodiments to be described, the golfer may first practice with the device attached to the body in order to attain total body proper muscle control and then practice without the device to help insure that this control has been attained. After this, golfer may test his skills on the course without the device to determine if further practice is warranted with or without the device.

Figure 8:
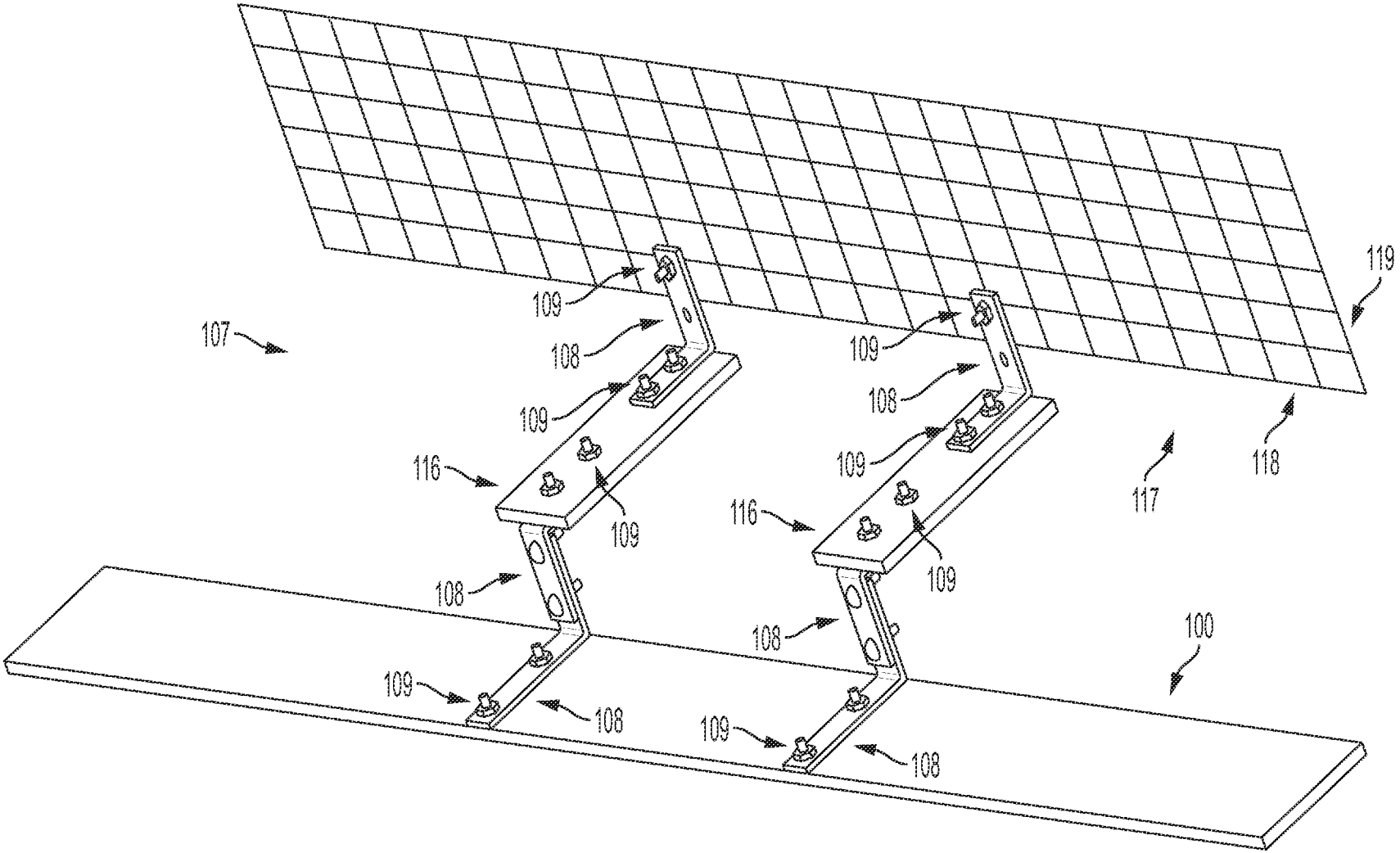
FIG. 8 is a perspective view of a fixed grid embodiment of a putting alignment training device in accordance with the present invention.

Referring now to FIG. 8, the construction of the fixed grid embodiment 120 is shown. The L brackets 108 are attached to the shoulder board 105 by fasteners, such as, but not limited to, nuts and bolts 109. Attached to these L brackets 108, by nuts and bolts, are two extender boards 116. Attached to these extender boards 116, by nuts and bolts 109, are two L brackets 108. Attached to these two L brackets 108 is a grid 117, constructed similarly to that described in the adjustable grid embodiment 106. Preferred materials of these components are the same as described previously for the adjustable grid embodiment 106.

Now that the fixed grid embodiment 120 construction has been explained we can describe how the invention works using the fixed grid embodiment 120. The operation is the same as the adjustable grid embodiment 106, with the only difference being that there is no adjustable feature. Therefore, the golfer needs to bend slightly at the waist to line up the line from ball 128 to hole 129 prior to making the previously described shoulder rotation.

Figure 16:
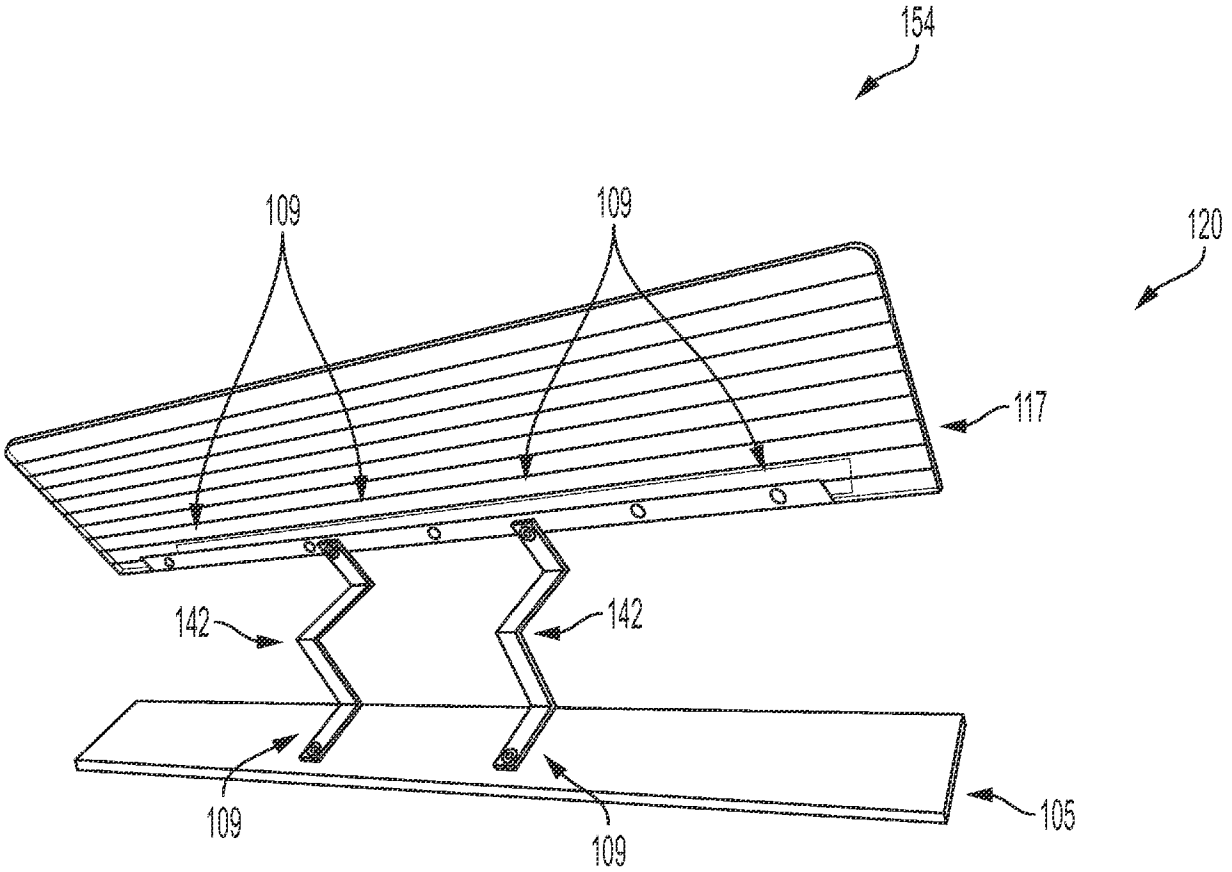
FIG. 16 is a perspective view of an alternate embodiment of a putting alignment training device in accordance with the present invention.
Figure 17:
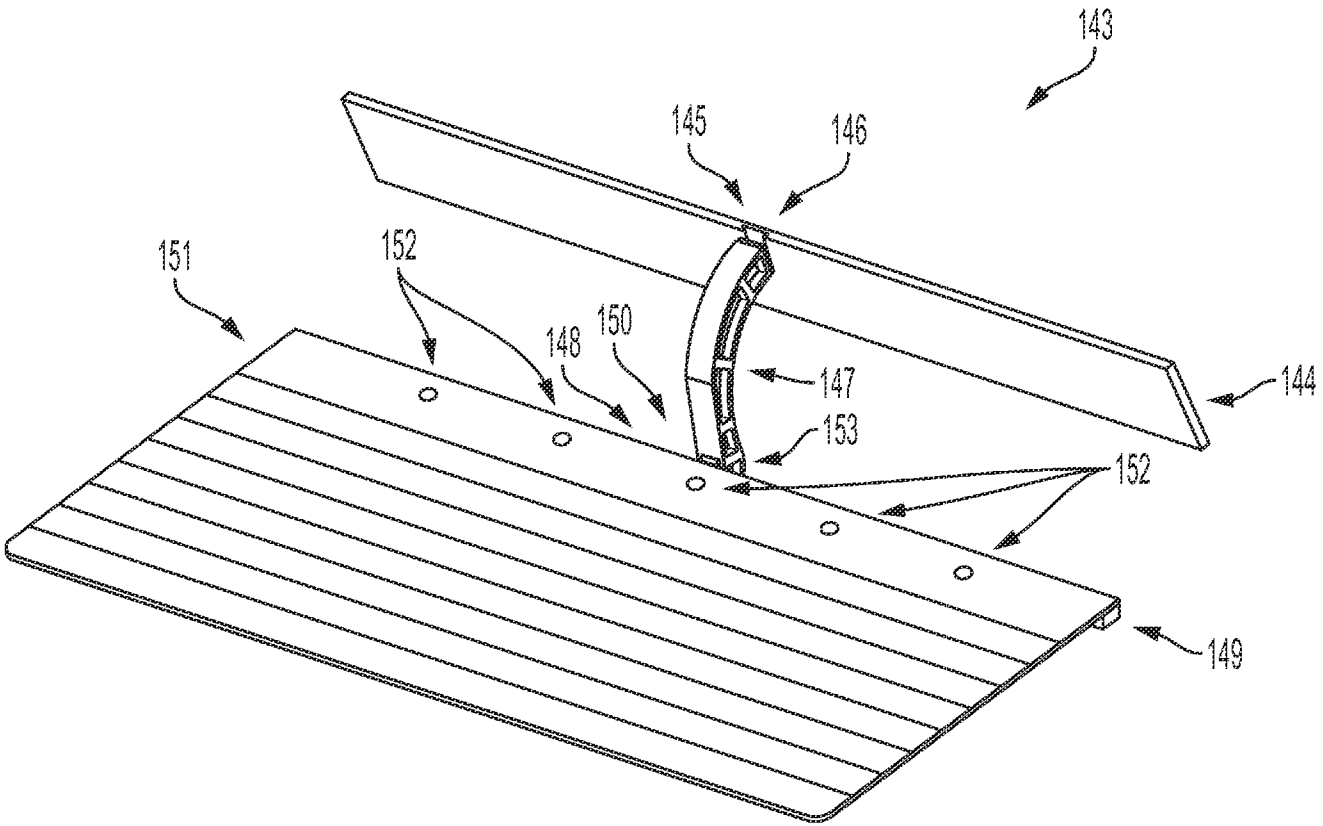
FIG. 17 is a perspective view of an alternate embodiment of a putting alignment training device in accordance with the present invention.

Referring now to FIG. 16, the construction of the fixed grid embodiment with a continuous connector 154 is described. Attached to the shoulder board 105, by nuts and bolts, is a continuous connector 142 with zig-zag shape. This shape allows the grid 117 to be down and away from the golfer. Attached to the continuous connector 142, by nuts and bolts, is a stabilizer bar 155 and the grid 117. The stabilizer bar 155 includes multiple holes, that in concert with holes in the grid 117, provide stability to the grid 117 if it is moved laterally by removing and reattaching nuts and bolts 109 with optional wing nuts 109. The fixed grid embodiment with continuous connector 154 works similarly to the fixed grid embodiment 120 which is described previously.

Figure 18A:
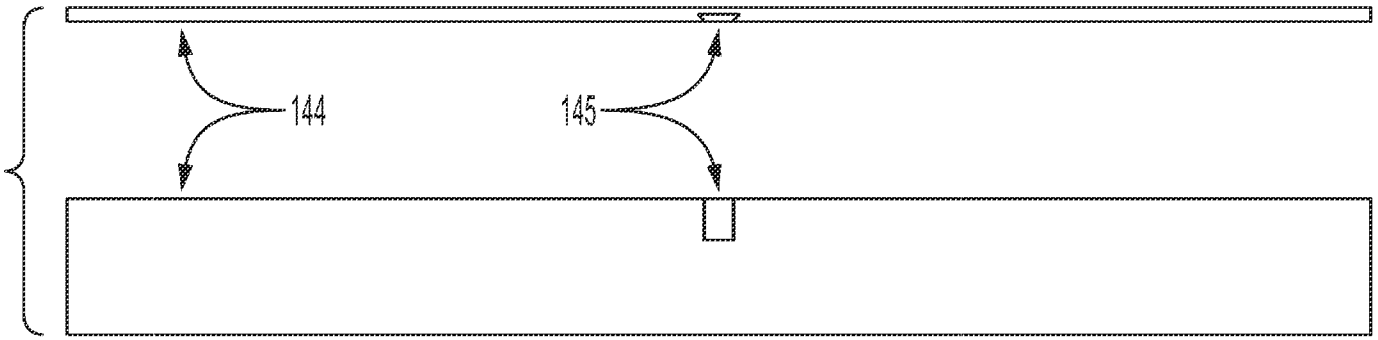
FIGS. 18A-18C are various perspective views of the components of the putting alignment training device shown in FIG. 17.
Figure 18B:
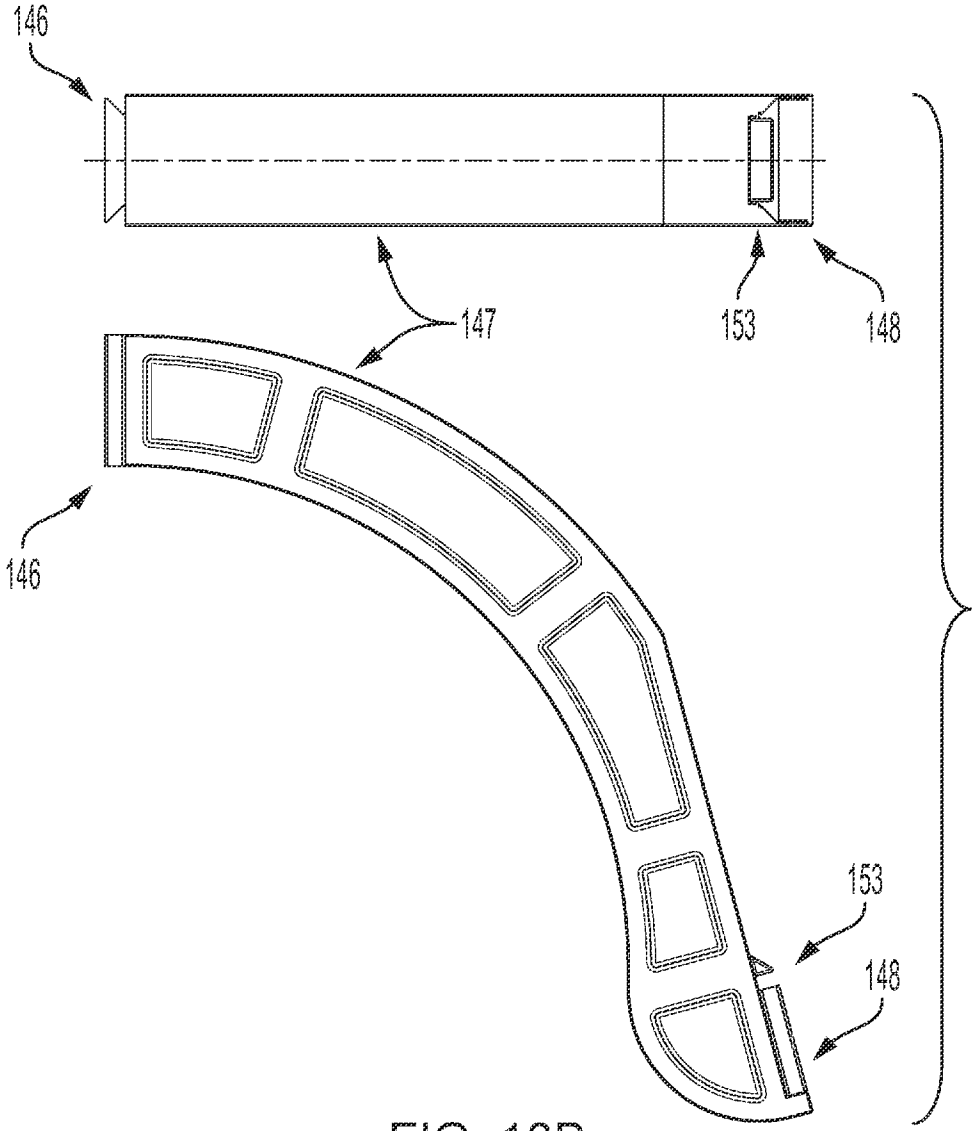
Figure 18C:
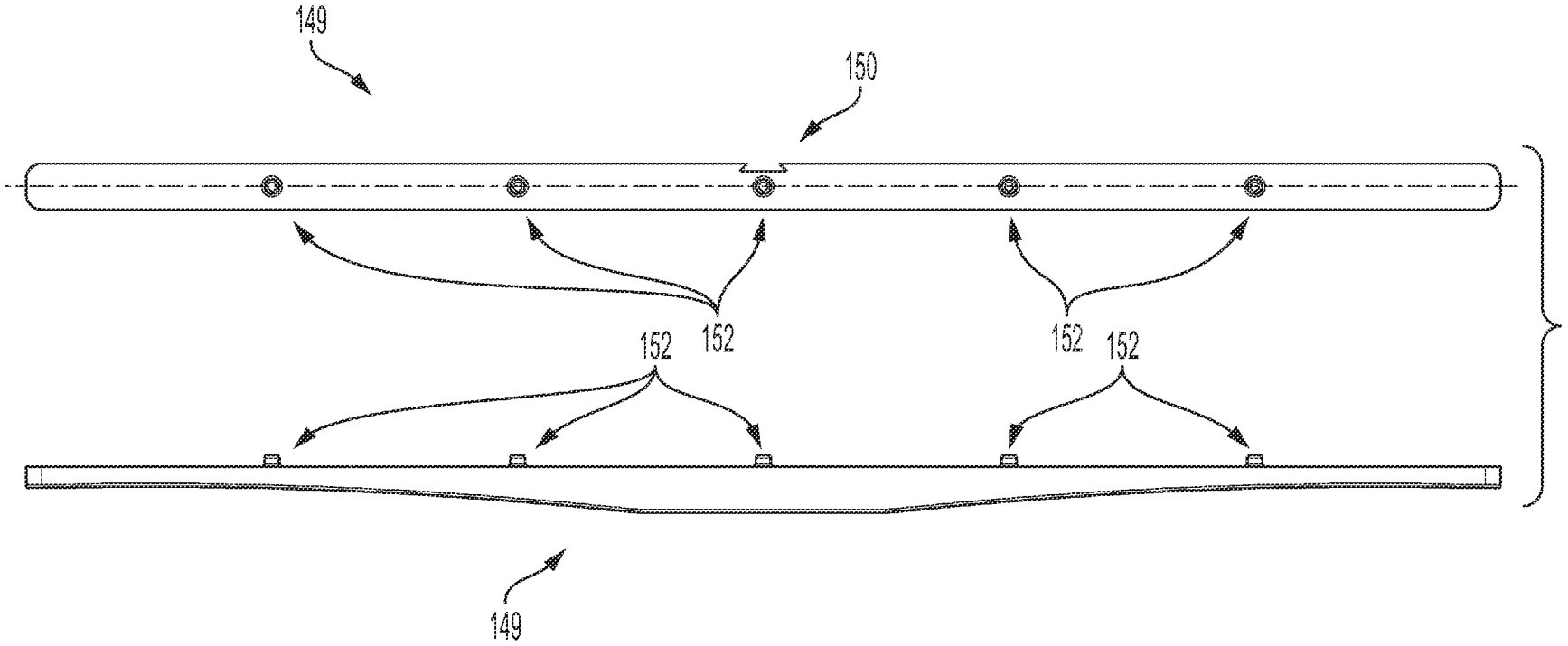

Referring now to FIGS. 17 and 18, the assembly embodiment 143 is described. Preferably, the assembly embodiment 143 can be assembled or disassembled without nuts and bolts. Preferably, all materials of the assembly embodiment 143, with the exception of the grid 151, are some form of plastic, such as acrylonitrile butadiene styrene (ABS), or similar materials. The shoulder board 144 of the assembly embodiment 143 is attached to the connector 147 by inserting the connector tenon 146 into the shoulder board mortise 145. The connector 147 is attached at the other end to the stabilizer bar 149 by inserting the connector tenon 148 into the stabilizer bar mortise 150. The grid 151 is attached to the stabilizer bar 149 by snapping on of the holes in the grid to projections 152 on the stabilizer bar 149. There are multiple projections on the stabilizer bar 149 and multiple holes in the grid 151 so that that the grid 151 can be easily moved laterally by unsnapping the grid 151, moving the grid 151, and snapping the grid 151 back on the projections 152 to allow for longer putts. Also, on the connector is a flap 153 that is used to hold the grid 151 in place. The assembly grid embodiment 143 works similarly to the fixed grid embodiment with a continuous connector 154.

Figure 9:
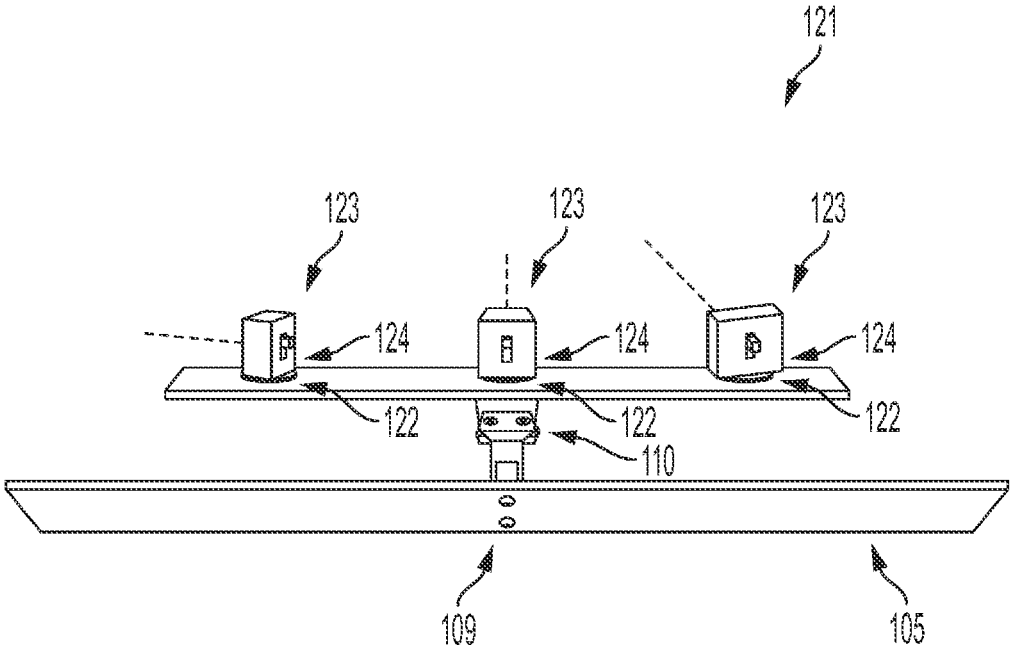
FIG. 9 is an alternate embodiment of a putting alignment training device in accordance with the present invention.
Figure 10:
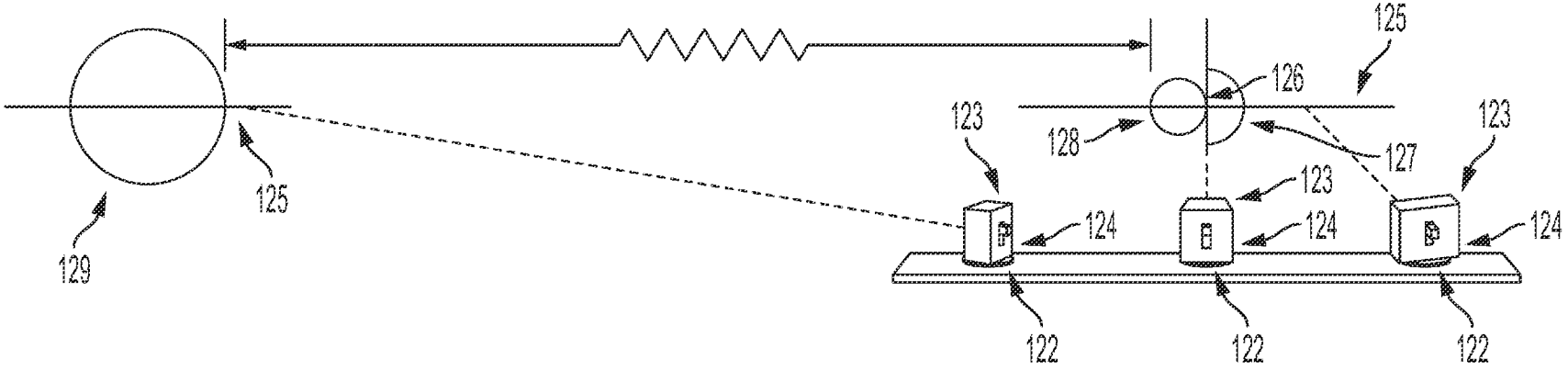
FIG. 10 is a schematic depiction of the putting alignment training device shown in FIG. 9.

Referring now to FIGS. 9 and 10, the single line laser embodiment 121 is described. Preferably, the shoulder board 100, adjustable connector 110. and frontal board 115 of the single line laser embodiment 121 are constructed similarly to those described above with regard to the adjustable grid embodiment 106, with the exception that the frontal board 115 will preferably be of a longer length. Preferably, three magnets 122 are attached to the frontal board 115 by adhesive. The preferred configuration of the magnets 122 is a round disc, but other configurations may be used. As shown in FIG. 9, two magnets 122 are near the ends of the frontal board 115 and one magnet 122 is in the center. Attached to the magnets 122 are single line lasers 123. If the lasers are made of a material is magnetic, such as plastic, a thin metal strip 124 is attached to the lasers. This embodiment allows the lasers to be rotated. As can be seen in FIG. 9 and the schematic of FIG. 10, the lasers 123 are pointed such that the two lasers at the ends of the frontal board 115 are directed so that the horizontal beam 125 of one is focused on the ball and the horizontal beam 125 of the other is focused on the hole 129. The center laser 123 is pointed perpendicular to these horizontal line beams 125 such that its beam 125 is focused on the putter face 126.

The single line laser embodiment 121 works the same as the previously discussed embodiments utilizing grids with the exception that instead of using grid lines 118 and 119 to align the golfer's body and the putter, the laser lines 125 are used. Because there is only a single laser line rather than multiple horizontal lines on a grid 117, the golfer will need to bend at the waist to line up his feet and then unbend to line up the line from ball to hole prior to rotating the shoulders as necessary.

Figure 11:
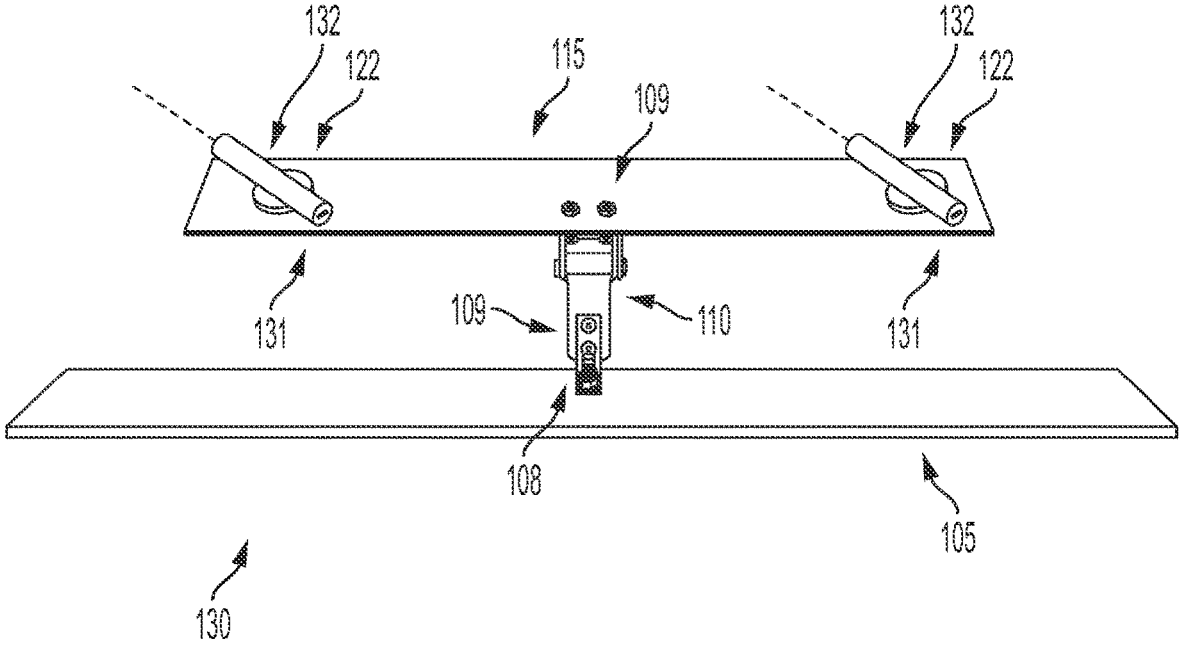
FIG. 11 is an alternate embodiment of a putting alignment training device in accordance with the present invention.
Figure 12:
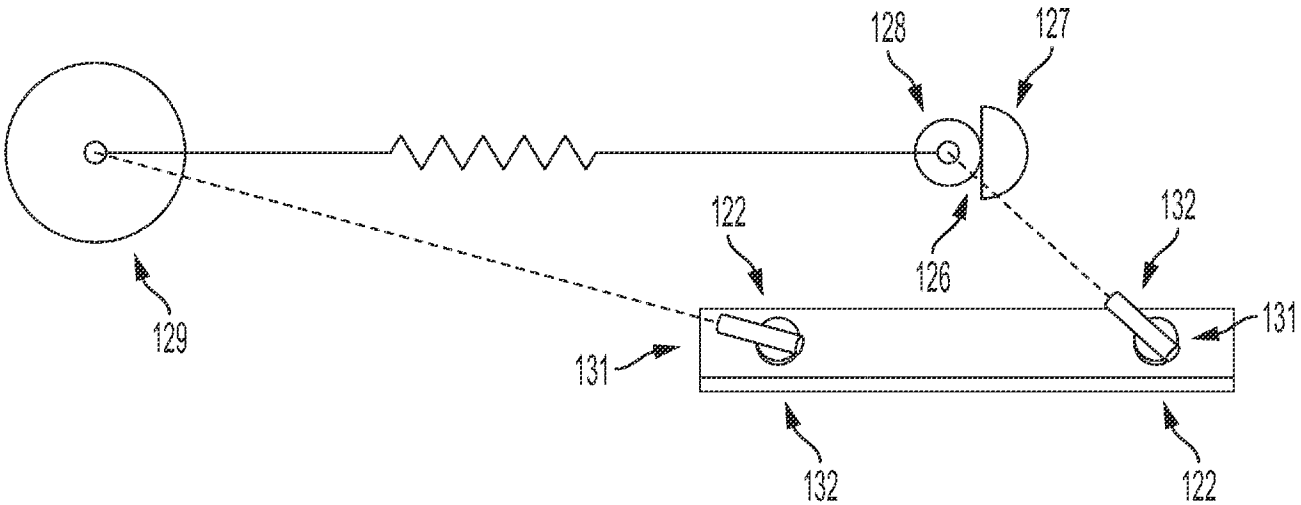
FIG. 12 is a schematic depiction of the putting alignment training device shown in FIG. 11.

The pointer lasers embodiment 126 is shown in FIGS. 11 and 12. Construction of this embodiment is the same as the single line lasers embodiment 121, with the exception that instead of three magnets 122, there are two magnets, and instead of three line lasers 123, there are two pointer lasers 131 attached to the magnets. The pointer lasers 131 can be of different materials, but if not magnetic, as most are not, then a metal clip 132 can be attached to each pointer laser 131. As shown, one laser 131 is pointed at the center of the ball 128 and one at the center of the hole 129. The pointer laser embodiment 130 works in the same manner as the single line laser embodiment 121, with the exception that instead of lining up the shoulder and feet with horizontal lines of the grid 117, the shoulders 128 are rotated so that one laser dot 157 hits the center of the ball 128 and one hits the center of the hole 129. The golfer's feet are lined up by bending at the waist to affix the laser dots 157 to the tips of the toes.

Figure 13:
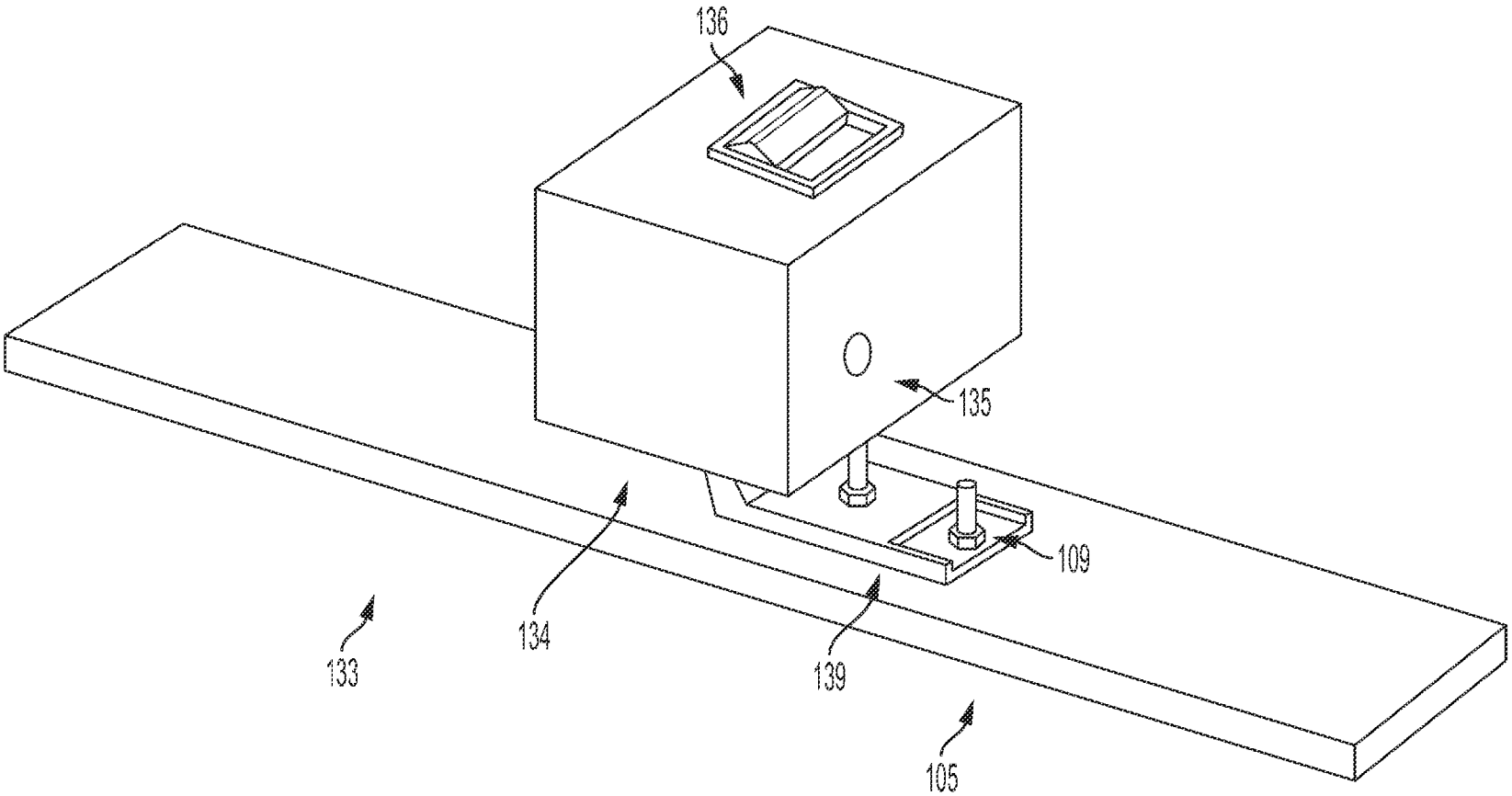
FIG. 13 is a perspective side view of an alternate embodiment of a putting alignment training device in accordance with the present invention.
Figure 14:
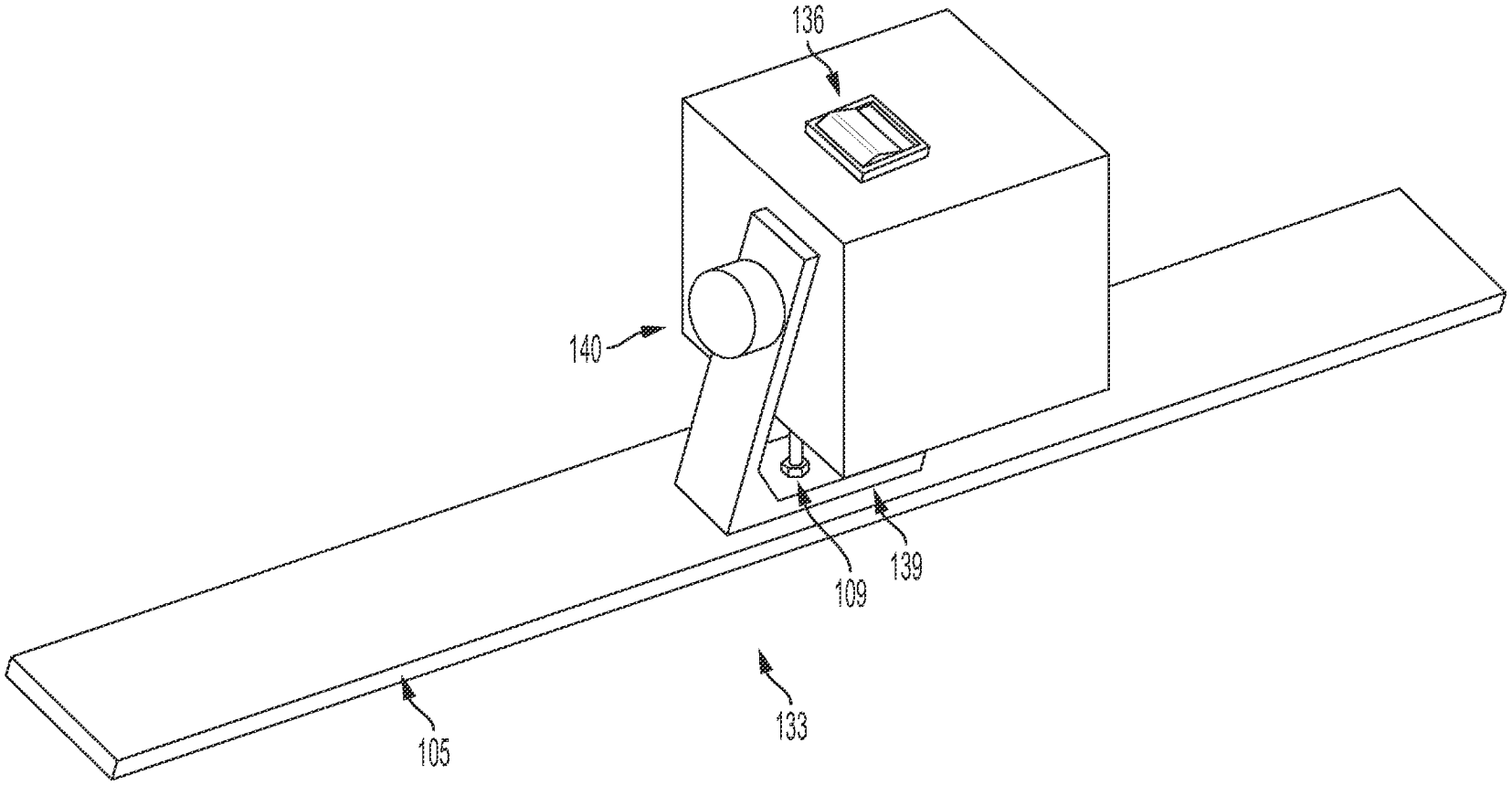
FIG. 14 is a perspective opposite side view of the putting alignment training device shown in FIG. 13.
Figure 15:
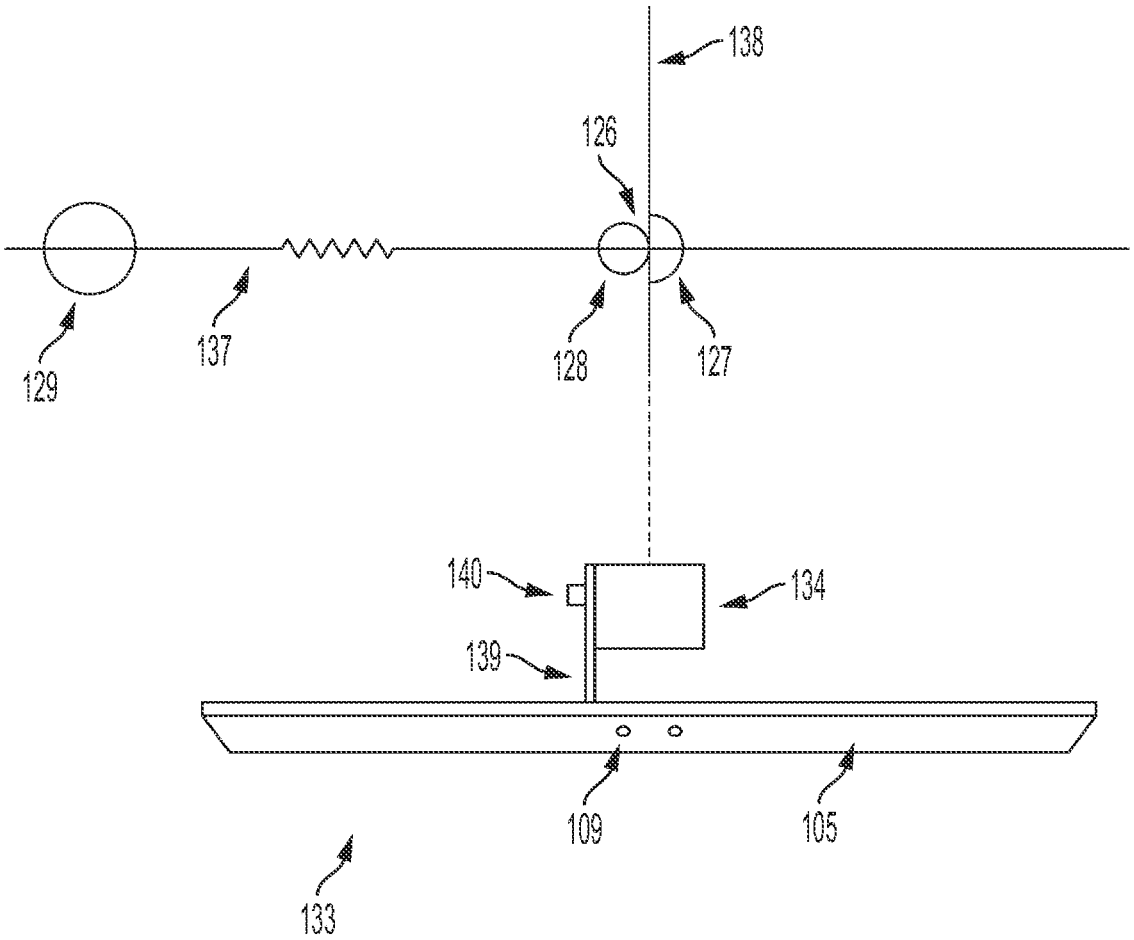
FIG. 15 is a schematic of the putting alignment training device shown in FIGS. 13 and 14.

As shown in FIGS. 13, 14, and 15, the dual line laser embodiment 133 attaches directly to the shoulder board 105. The dual line laser embodiment 133 works in the same manner as the two previously discussed laser embodiments with the exception that the laser simultaneously emits both a horizontal beam 137 and a vertical beam 138 to meet in crosshairs on the putting surface. The horizontal beam 137 is used to line up the feet and shoulders of the golfer to the line from the ball 128 to the hole 129, and the vertical beam 138 is used to line up the putter face 126.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

REFERENCE NUMBERS

100 Shoulder Harness
101 Harness Strap
102 Harness Connector Strap
103 Harness Pad
104 Adjustable Shoulder Straps
105 Shoulder Board
106 Adjustable Grid Embodiment
107 Plastic Locking Component
108 L Bracket
109 Nuts and Bolts with Optional Wing Nuts
110 Adjustable Connector
111 Shoulder Board Connector Component
112 Frontal Board Connector Component
113 Cylindrical Part
114 Adjustable connector Set Screw
115 Frontal Board
116 Extender Board
117 Grid
118 Horizontal Grid Lines
119 Vertical Grid Lines
120 Fixed Grid Embodiment
121 Single Line Lasers Embodiment
122 Magnet
123 Single Line Laser
124 Thin Metal Plate
125 Line Laser Beam
126 Putter Face
127 Putter head
128 Ball
129 Hole
130 Pointer Lasers Embodiment
131 Pointer Laser
132 Metal Clip
133 Dual line Lasers Embodiment
134 Dual Line Laser
135 On/off Button
136 Mode Selector
137 Dual Line Laser Horizontal Beam
138 Dual Line Laser Vertical Beam
139 Dual Laser L Bracket
140 Dual Laser Set Screw
142 Continuous Connector
143 Assembly Grid Embodiment
144 Assembly Shoulder Board
145 Shoulder Board Mortise
146 Connector Tenon that Attaches to Shoulder Board Mortise
147 Assembly Connector
148 Connector Tenon that Attaches to Stabilizer Bar Mortise
149 Assembly Stabilizer Bar
150 Stabilizer Bar Mortise
151 Assembly Grid
152 Assembly Projections
153 Assembly Flap
154 Fixed Grid Embodiment with Continuous Connector
155 Stabilizer Bar

The invention claimed is:

1. A putting alignment training device that is securable to a front side of an upper torso of a user, comprising:

an elongated shoulder board having a longitudinal center axis;

an adjustable harness that is secured to the elongated shoulder board and configured to secure the training device to the front side of the upper torso;

a connector;

a grid board secured to the elongated shoulder board by the connector, the grid board including a grid formed by at least one horizontal line;

wherein one of the at least one horizontal line is parallel to the longitudinal center axis of the shoulder board.

2. The putting alignment training device of claim 1, wherein the grid board is comprised of a transparent material.

3. The putting alignment training device of claim 2, wherein the at least one horizontal line further comprises a plurality of horizontal lines, each horizontal line being parallel to the longitudinal center axis of the shoulder board.

4. The putting alignment training device of claim 3, wherein the grid further comprises a plurality of vertical lines, each vertical line being transverse to the horizontal lines.

5. The putting alignment training device of claim 2, wherein the grid board is secured to the elongated shoulder board in a fixed position.

6. The putting alignment training device of claim 2, wherein the connector further comprises an adjustable connector having a pivot axis that is parallel to the longitudinal center axis of the elongated shoulder board so that the grid board is rotatable with respect to the elongated shoulder board about the pivot axis.

7. The putting alignment training device of claim 2, wherein the grid board is movable between a first axial position and a second axial position with respect to the longitudinal center axis of the elongated shoulder board.

8. A putting alignment training device that is securable to a front side of an upper torso of a user, comprising:

an elongated shoulder board having a first mortise and a longitudinal center axis;

a connector having a first tenon that is slidably received in the first mortise of the elongated shoulder board;

a grid board, the grid board including at least one horizontal line, the grid board being secured to the elongated shoulder board;

wherein the at least one horizontal line is parallel to the longitudinal center axis of the shoulder board.

9. The putting alignment device of claim 8, further comprising an adjustable harness that is secured to the elongated shoulder board and configured to secure the training device to the front side of the upper torso.

10. The putting alignment training device of claim 8, wherein the grid board is comprised of a transparent material.

11. The putting alignment training device of claim 10, further comprising:

a stabilizer bar including a second mortise, wherein the connector further includes a second tenon that is slidably received in the second mortise of the stabilizer bar, and the grid board is secured to the stabilizer bar.

12. The putting alignment training device of claim 8, wherein the at least one horizontal line further comprises a plurality of horizontal lines, each horizontal line being parallel to the longitudinal center axis of the shoulder board.

* * * * *